US006187522B1

(12) United States Patent
Majumdar et al.

(10) Patent No.: US 6,187,522 B1
(45) Date of Patent: Feb. 13, 2001

(54) SCRATCH RESISTANT ANTISTATIC LAYER FOR IMAGING ELEMENTS

(75) Inventors: Debasis Majumdar, Rochester; Charles C. Anderson, Penfield, both of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/276,530

(22) Filed: Mar. 25, 1999

(51) Int. Cl.[7] ..... G03C 1/74; G03C 1/85

(52) U.S. Cl. ..... 430/527; 430/530; 430/531; 430/533; 430/536

(58) Field of Search ..... 430/527, 530, 430/531, 533, 536

(56) References Cited

U.S. PATENT DOCUMENTS

| | | | | |
|---|---|---|---|---|
| 4,070,189 | | 1/1978 | Kelley et al. . | |
| 4,275,103 | | 6/1981 | Tsubusaki et al. . | |
| 4,394,441 | * | 7/1983 | Kawaguchi et al. | 430/524 |
| 4,416,963 | | 11/1983 | Takimoto et al. . | |
| 4,418,141 | | 11/1983 | Kawaguchi et al. . | |
| 4,431,764 | | 2/1984 | Yoshizumi . | |
| 4,495,276 | | 1/1985 | Takimoto et al. . | |
| 4,571,361 | | 2/1986 | Kawaguchi et al. . | |
| 4,731,408 | | 3/1988 | Jasne . | |
| 4,880,703 | | 11/1989 | Sakamoto et al. . | |
| 4,987,042 | | 1/1991 | Jonas et al. . | |
| 4,999,276 | | 3/1991 | Kuwabara et al. . | |
| 5,093,439 | | 3/1992 | Epstein et al. . | |
| 5,122,445 | | 6/1992 | Ishigaki . | |
| 5,273,822 | | 12/1993 | Hayashi et al. . | |
| 5,294,525 | | 3/1994 | Yamauchi et al. . | |
| 5,300,575 | | 4/1994 | Jonas et al. . | |
| 5,312,681 | | 5/1994 | Muys et al. . | |
| 5,340,676 | | 8/1994 | Anderson et al. . | |
| 5,350,448 | | 9/1994 | Dietz et al. . | |
| 5,354,613 | | 10/1994 | Quintens et al. . | |
| 5,368,995 | | 11/1994 | Christian et al. . | |
| 5,370,981 | | 12/1994 | Krafft et al. . | |
| 5,372,924 | | 12/1994 | Quintens et al. . | |
| 5,382,494 | | 1/1995 | Kudo et al. . | |
| 5,391,472 | | 2/1995 | Muys et al. . | |
| 5,403,467 | | 4/1995 | Jonas et al. . | |
| 5,443,944 | | 8/1995 | Krafft et al. . | |
| 5,459,021 | | 10/1995 | Ito et al. . | |
| 5,466,567 | | 11/1995 | Anderson et al. . | |
| 5,484,694 | | 1/1996 | Lelental et al. . | |
| 5,536,627 | * | 7/1996 | Wang et al. | 430/523 |
| 5,575,898 | | 11/1996 | Wolf et al. . | |
| 5,585,037 | | 12/1996 | Linton . | |
| 5,628,932 | | 5/1997 | Linton . | |
| 5,665,498 | * | 9/1997 | Savage et al. | 430/41 |
| 5,674,654 | | 10/1997 | Zumbulyadis et al. . | |
| 5,679,505 | | 10/1997 | Tingler et al. . | |
| 5,700,623 | | 12/1997 | Anderson et al. . | |
| 5,716,055 | | 2/1998 | Gardner et al. . | |
| 5,726,001 | * | 3/1998 | Eichorst | 430/523 |
| 5,955,250 | * | 9/1999 | Christian et al. | 430/528 |

FOREIGN PATENT DOCUMENTS

| | | |
|---|---|---|
| 0 602713 | 6/1994 | (EP) . |
| 4055492 | 2/1992 | (JP) . |
| 97 38358 | 10/1997 | (WO) . |

* cited by examiner

*Primary Examiner*—Janet Baxter
*Assistant Examiner*—Amanda C. Walke
(74) *Attorney, Agent, or Firm*—Doreen M. Wells

(57) ABSTRACT

The present invention is an imaging element having, a support, an image-forming layer superposed on the support and an outermost scratch resistant antistatic layer superposed on the support. The outermost scratch resistant antistatic layer has a thickness between 0.6 and 10 microns. The scratch resistant layer is composed of a polymer having a modulus greater than 100 MPa measured at 20° C. and a tensile elongation to break greater than 50%, a filler particle having a modulus greater than 10 GPa, and an electrically conducting polymer. The volume ratio of the polymer to the filler particle is between 70:30 and 40:60 and the electrically conducting polymer is present at a weight concentration based on a total dried weight of the scratch resistant layer of between 1 and 10 weight percent.

12 Claims, No Drawings

SCRATCH RESISTANT ANTISTATIC LAYER FOR IMAGING ELEMENTS

FIELD OF THE INVENTION

This invention relates to imaging elements having an improved scratch resistant layer with "process-surviving" antistatic characteristics. In particular, this invention relates to scratch resistant layers comprising a ductile polymer, a hard filler and an electrically conducting polymer.

BACKGROUND OF THE INVENTION

Microscratches are scratches that are on the order of several microns in width and submicron to microns in depth. They are commonly observed on the front and back sides of photographic films, on photoconductor belts, on thermal prints, and on PhotoCD disks. They are caused by sliding contact of imaging products with dirt particles or other asperities that have micron-sized contact radii. These scratches can affect analog or digital image transfer and degrade the output image quality. Their presence on magnetic or conductive backings could lessen the performance of these functional coatings. Thus, scratch resistance protective coatings on the front or back or both sides of an imaging product are commonly required.

Since all imaging products are based on flexible substrates for ease of transport, conveyance, and manufacturing, hard metallic or ceramic tribological scratch resistant coatings are not suitable due to their mechanical incompatibility with the polymeric flexible substrates. This mechanical incompatibility can cause adhesion failure between the coating and the substrate during scratching. Polymeric coatings are thus preferable as the scratch resistant layer for imaging products. However, with the requirements for high light transmission, low material cost, low internal drying stress, and high coating speeds, the thickness of these scratch resistant coatings is preferably about 10 microns or less.

During micro-scratching of a micron-thick coating, complex stress fields develop in the coating, within which high internal shear stress, interfacial shear stress, and surface tensile stress are present. A coating can fail either by shear fracture, delamination, or tensile cracking depending on the relative shear, adhesive, and tensile strengths of the coating. Using a micro-scratching instrument with a single micron-sized stylus, the resistance to scratch damage for a coating can be measured. Combining this instrument with optical microscopy, the failure mode, such as shear fracture, delamination, or tensile cracking, can be determined. All these failure modes produce scratches that are printable and scanable and, thus, unacceptable for imaging products. A permanent scratch track resulting from plastic deformation of a ductile coating without coating failure is also printable and scanable, and thus, not desirable.

Various types of polymeric coatings have been examined as scratch resistant coatings for imaging products. These include coatings comprising brittle, ductile, elastic-plastic, or rubber-elastic polymeric materials. Brittle polymers with elongations to break less than 5%, such as poly(methyl methacrylate) and poly(styrene) are not desirable as scratch resistant coatings for imaging products. Regardless of the coating thickness, the brittleness of these materials leads to printable surface tensile cracks during scratching. Soft elastomers (rubber-elastic materials), such as urethane rubbers, acrylic rubbers, silicone rubbers, are not suitable as scratch resistant coatings since deep penetration of the asperity or stylus occurs in these soft coatings which causes these elastomeric coatings to fail at low loads during scratching.

Using stiff fillers to increase the stiffness of these elastomers to reduce stylus penetration does not solve this problem since permanent and printable scratch tracks result in elastomeric coatings containing stiff fillers by the induced coating plasticity under the presence of stiff fillers.

Ductile elastic-plastic coatings with elongations to break greater than 10%, such as glassy polyurethanes, polycarbonate, cellulose esters, etc., exhibit shear-fracture-type scratch damage during scratching that result from plastic flow. Plastic flow in these ductile coatings during scratching is controlled by the coating thickness. For thin coatings of these materials, plastic flow in the coating during scratching is restricted by the coating adhesion to the substrate leading to a premature failure of the coatings at low loads. Thicker coatings for these materials may have improved resistance to coating failure, however, for imaging products these thicknesses may be impractical. In addition, although thick ductile coatings have improved resistance to coating failure during scratching, the low yield strength and modulus for these materials result in the formation of permanent scratch tracks in the coatings at low loads.

It can be seen that various approaches have been attempted to obtain an improved scratch resistant layer for imaging products. However, the aforementioned methods have met with only limited success. Recently, in commonly-assigned U.S. Ser. No. 09/089,794 a coating composition is disclosed with resistance to the formation of permanent scratch tracks and coating failure when an imaging product is exposed to sharp asperities or other conditions that may lead to scratches during the manufacture and use of the imaging product. However, such a backing does not necessarily provide any antistatic characteristics required of an imaging element for its successful manufacture, finishing and subsequent use. Although a number of oxides with electronic conductivity have been proposed as stiff fillers in U.S. Ser. No. 09/089,794, their inclusion at the proposed dry volume fraction and coverage is likely to impart unacceptable levels of color and haze to the photographic element. Moreover, due to the highly filled nature of such a backing, it cannot be used as a barrier layer, against photographic processing solutions, over vanadium oxide based antistats disclosed in U.S. Pat. 5,679,505 and references therein and, hence, will not insure "process-surviving" conductivity of such antistats. The present invention is intended to provide improved scratch resistance and antistatic properties, before and after film processing, all in a single layer with acceptable optical properties for application in imaging elements.

The problem of controlling static charge is well known in the field of photography. The accumulation of charge on film or paper surfaces leads to the attraction of dirt which can produce physical defects. The discharge of accumulated charge during or after the application of the sensitized emulsion layer(s) can produce irregular fog patterns or "static marks" in the emulsion. The static problems have been aggravated by increases in the sensitivity of new emulsions, increases in coating machine speeds, and increases in post-coating drying efficiency. The charge generated during the coating process may accumulate during winding and unwinding operations, during transport through the coating machines and during finishing operations such as slitting and spooling. Static charge can also be generated during the use of the finished photographic film product. In an automatic camera, the winding of roll film in and out of the film cartridge, especially in a low relative humidity environment, can result in static charging. Similarly, high speed automated film processing can result in static charge generation. Sheet films (e.g., x-ray films) are especially susceptible to static charging during removal from light-tight packaging.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivity. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during photographic processing, resulting in a loss of antistatic function. The conductivity of antistatic layers employing an electronic conductor depends on electronic mobility rather than ionic mobility and is independent of humidity.

Antistatic layers containing electronic conductors such as conjugated conducting polymers, conducting carbon particles, crystalline semiconductor particles, amorphous semiconductive fibrils, and continuous semiconducting thin films can be used more effectively than ionic conductors to dissipate static charge since their electrical conductivity is independent of relative humidity and only slightly influenced by ambient temperature. Of the various types of electronic conductors, electrically conducting metal-containing particles, such as semiconducting metal oxides, are particularly effective when dispersed in suitable polymeric film-forming binders in combination with polymeric non-film-forming particles as described in U.S. Pat. Nos. 5,340,676; 5,466,567; 5,700,623. Binary metal oxides doped with appropriate donor heteroatoms or containing oxygen deficiencies have been disclosed in prior art to be useful in antistatic layers for photographic elements, for example, U.S. Pat. Nos. 4,275,103; 4,416,963; 4,495,276; 4,394,441; 4,418,141; 4,431,764; 4,571,361; 4,999,276; 5,122,445; 5,294,525; 5,382,494; 5,459,021; 5,484,694 and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include antimony-doped tin oxide, fluorine-doped tin oxide, aluminum-doped zinc oxide, and niobium-doped titania. Additional preferred conductive ternary metal oxides disclosed in U.S. Pat. No. 5,368,995 include zinc antimonate and indium antimonate. Other conductive metal-containing granular particles including metal borides, carbides, nitrides and suicides have been disclosed in Japanese Kokai No. JP 04-055,492.

One serious deficiency of such granular electronic conductor materials is that, especially in the case of semiconductive metal-containing particles, the particles usually are highly colored which render them unsuitable for use in coated layers on many photographic supports, particularly at high dry weight coverage. This deficiency can be overcome by using composite conductive particles consisting of a thin layer of conductive metal-containing particles deposited onto the surface of non-conducting transparent core particles whereby obtaining a lightly colored material with sufficient conductivity. For example, composite conductive particles consisting of two dimensional networks of fine antimony-doped tin oxide crystallites in association with amorphous silica deposited on the surface of much larger, non-conducting metal oxide particles (e.g., silica, titania, etc.) and a method for their preparation are disclosed in U.S. Pat. Nos. 5,350,448; 5,585,037 and 5,628,932. Alternatively, metal-containing conductive materials, including composite conducting particles, with high aspect ratio can be used to obtain conducting coatings with lighter color due to reduced dry weight coverage (vide, for example, U.S. Pat. Nos. 4,880,703 and 5,273,822). However, there is difficulty in the preparation of conductive coatings containing composite conductive particles, especially the ones with high aspect ratio, since the dispersion of these particles in an aqueous vehicle using conventional wet milling dispersion techniques and traditional steel or ceramic milling media often result in wear of the thin conducting layer from the core particle and/or reduction of the aspect ratio. Fragile composite conductive particles often cannot be dispersed effectively because of limitations on milling intensity and duration dictated by the need to minimize degradation of the morphology and electrical properties as well as the introduction of attrition-related contamination from the dispersion process.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are environmentally benign, which are durable and scratch-resistant, which are adaptable to use with transparent imaging elements, which do not exhibit adverse sensitometric or photographic effects, and which maintain electrical conductivity even after coming in contact with processing solutions (since it has been observed in industry that loss of electrical conductivity after processing may increase dirt attraction to processed films which, when printed, may cause undesirable defects on the prints).

It is towards the objective of providing a scratch-resistant, antistatic layer for imaging elements especially for silver halide photographic films that survives film processing that the present invention is directed. The layer of the present invention comprises in particular a specific ductile polymer, a hard filler and an electrically conducting polymer.

Electrically conducting polymers have recently received attention from various industries because of their electronic conductivity. Although many of these polymers are highly colored and are less suited for photographic applications, some of these electrically conducting polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as mentioned in U.S. Pat. Nos. 5,716,550; 5,093,439 and 4,070,189) are transparent and not prohibitively colored, at least when coated in thin layers at moderate coverage. Because of their electronic conductivity instead of ionic conductivity, these polymers are conducting even at relative humidity as low as 5%, as demonstrated in copending applications U.S. Ser. Nos. 09/173,409 and 09/172,878. Moreover, these polymers can retain sufficient conductivity even after wet chemical processing to provide what is known in the art as "process-surviving" antistatic characteristics to the photographic support they are applied to, as also demonstrated in copending applications U.S. Ser. Nos. 09/173,409 and 09/172,878. Unlike metal-containing semiconducting particulate antistatic materials (e.g., antimony-doped tin oxide), the aforementioned electrically conducting polymers are less abrasive, environmentally more acceptable (due to absence of heavy metals), and, in general, less expensive.

However, it has been reported (U.S. Pat. No. 5,354,613) that the mechanical strength of a thiophene-containing polymer layer is not sufficient and can be easily damaged without an overcoat. Protective layers such as poly(methyl methacrylate) can be applied on such thiophene-containing antistat layers but these protective layers typically are coated out of organic solvents and therefore not highly desired. More over, these protective layers may be too brittle to be an external layer for certain applications, such as motion picture print films (as illustrated in U.S. Pat. No. 5,679,505). Use of aqueous polymer dispersions (such as vinylidene chloride, styrene, acrylonitrile, alkyl acrylates and alkyl methacrylates) has been taught in U.S. Pat. No. 5,312,681 as an overlying barrier layer for thiophene-containing antistat layers, and onto the said overlying barrier layer is adhered a hydrophilic colloid-containing layer. But, again, the physical properties of these barrier layers may preclude their use as an outermost layer in certain applications. The use of a thiophene-containing outermost antistat layer has been taught in U.S. Pat. No. 5,354,613 wherein a hydrophobic polymer with high glass transition temperature is incorporated in the antistat layer. But these hydrophobic polymers reportedly may require organic solvent(s) and/or swelling agent(s) "in an amount of at least 50% by weight," for coherence and film forming capability.

As will be demonstrated hereinbelow, the present invention provides a scratch resistant antistatic layer comprising a specific ductile polymer, a hard filler and an electrically conducting polymer which provides certain advantages over the teachings of the prior art including the retention of antistatic properties after color photographic processing.

SUMMARY OF THE INVENTION

The present invention is an imaging element having, a support, an image-forming layer superposed on the support and an outermost scratch resistant antistatic layer superposed on the support. The outermost scratch resistant antistatic layer has a thickness between 0.6 and 10 microns. The scratch resistant layer is composed of a polymer having a modulus greater than 100 MPa measured at 20° C. and a tensile elongation to break greater than 50%, a filler particle having a modulus greater than 10 GPa, and an electrically conducting polymer. The volume ratio of the polymer to the filler particle is between 70:30 and 40:60 and the electrically conducting polymer is present at a weight concentration based on a total dried weight of the scratch resistant layer of between 1 and 10 weight percent.

DETAILED DESCRIPTION OF THE INVENTION

In accordance with this invention, an imaging element for use in an image forming process includes a support, an image-forming layer, and an outermost scratch resistant antistatic layer whose antistatic properties survive film processing. The scratch resistant layer is superposed on the front or back side of the imaging element and has a thickness between 0.6 and 10 microns. The scratch resistant layer contains a ductile polymer having a modulus greater than 100 MPa and an elongation to break greater than 50%, a stiff filler having a modulus greater than 10 GPa, and an electrically conducting polymer; wherein the volume ratio of the ductile polymer to the stiff filler is between 70:30 and 40:60 and the electrically conducting polymer is present at a weight concentration based on the total dried weight of the dried layer which is between 1 and 10 weight percent. Such a layer provides an electrical resistivity of less than 12 log Ω/□ in an ambient of 50% to 5% relative humidity. Additionally, such an antistatic layer provides electrical resistivity values of less than 12 log Ω/□ after undergoing typical color photographic film processing.

The imaging elements of this invention can be of many different types depending on the particular use for which they are intended. Such elements include, for example, photographic, electrostatographic, photothermographic, migration, electrothermographic, dielectric recording and thermal-dye-transfer imaging elements. Imaging elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. Details with respect to the composition and function of a wide variety of different imaging elements are provided in U.S. Pat. No. 5,340,676 and references described therein. The present invention can be effectively employed in conjunction with any of the imaging elements described in the '676 patent.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The photographic processing steps to which the raw film may be subject may include, but are not limited to the following:

1) color developing→bleach-fixing→washing/stabilizing;
2) color developing→bleaching→fixing→washing/stabilizing;
3) color developing→bleaching→bleach-fixing→washing/stabilizing;
4) color developing→stopping→washing→bleaching→washing→fixing→washing/stabilizing;
5) color developing→bleach-fixing→fixing→washing/stabilizing;
6) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. 5,313,243; U.S. Pat. No. 5,339,131.

The present invention is also directed to photographic systems where the processed element may be re-introduced into the cassette. These systems allow for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The scratch resistant antistatic layer of the invention is the outermost layer on the front or back side of the imaging element and comprises a ductile polymer, a stiff filler and an electrically conducting polymer. The ductile polymer is further defined as a polymer having a modulus measured at 20° C. which is greater than 100 MPa and a tensile elongation to break greater than 50%. The modulus and tensile elongation to break for a polymer film can be conveniently measured by the tensile testing method in accordance with ASTM D882. The stiff filler is defined as a filler material having a modulus greater than 10 GPa. The volume ratio of the ductile polymer to the stiff filler is between 70:30 and 40:60.

The electrically conducting polymer for the present invention can be chosen from any or combination of the substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as mentioned in U.S. Pat. Nos. 5,716,550; 5,093,439 and 4,070,189). Preferably, the electrically conductive polymer is 3,4-dialkoxy substituted polythiophene styrene sulfonate, polypyrrole styrene sulfonate or 3,4-dialkoxy substituted polypyrrole styrene sulfonate. The weight % of the electrically conducting polymer in the dried layer is between 1% and 10%, preferably between 2.5% and 5%. This combination of a ductile polymer with these modulus and elongation to break values, the stiff filler and the aforesaid electrically conducting polymers provides a dried layer having exceptional resistance to the formation of printable, permanent scratch tracks and to scratches caused by complete coating failure during the manufacture and use of the imaging element as well as antistatic properties that survive film processing. In a preferred embodiment, the scratch resistant antistatic layer of the invention is applied on the side of the imaging element opposite to the image forming layer.

Ductile polymers that meet the requirements of the present invention include polycarbonate, glassy polyurethanes and polyolefins. Glassy polymers such as polymethyl methacrylate, styrene, and cellulose esters, that have been described for use as scratch resistant layers for imaging elements are not desirable for use in the present invention due to their brittleness, especially when they are used in combination with stiff fillers. Of the ductile polymers useful in the present invention, polyurethanes are preferred due to their availability and excellent coating and film forming properties. In a most preferred embodiment of this invention, the polyurethane is a water dispersible polyurethane.

Water dispersible polyurethanes are well known and are prepared by chain extending a prepolymer containing terminal isocyanate groups with an active hydrogen compound, usually a diamine or diol. The prepolymer is formed by reacting a diol or polyol having terminal hydroxyl groups with excess diisocyanate or polyisocyanate. To permit dispersion in water, the prepolymer is functionalized with hydrophilic groups. Anionic, cationic, or nonionically stabilized prepolymers can be prepared.

Anionic dispersions contain usually either carboxylate or sulfonate functionalized co-monomers, e.g., suitably hindered dihydroxy carboxylic acids (dimethylol propionic acid) or dihydroxy sulphonic acids. Cationic systems are prepared by the incorporation of diols containing tertiary nitrogen atoms, which are converted to the quaternary ammonium ion by the addition of a suitable alkylating agent or acid. Nonionically stabilized prepolymers can be prepared by the use of diol or diisocyanate co-monomers bearing pendant polyethylene oxide chains. These result in polyurethanes with stability over a wide range of pH. Nonionic and anionic groups may be combined synergistically to yield "universal" urethane dispersions. Of the above, anionic polyurethanes are by far the most significant.

One of several different techniques may be used to prepare polyurethane dispersions. For example, the prepolymer may be formed, neutralized or alkylated if appropriate, then chain extended in an excess of organic solvent such as acetone or tetrahydrofuran. The prepolymer solution is then diluted with water and the solvent removed by distillation. This is known as the "acetone" process. Alternatively, a low molecular weight prepolymer can be prepared, usually in the presence of a small amount of solvent to reduce viscosity, and chain extended with diamine just after the prepolymer is dispersed into water. The latter is termed the "prepolymer mixing" process and for economic reasons is much preferred over the former.

Polyols useful for the preparation of polyurethane dispersions include polyester polyols prepared from a diol (e.g. ethylene glycol, butylene glycol, neopentyl glycol, hexane diol or mixtures of any of the above) and a dicarboxylic acid or an anhydride (succinic acid, adipic acid, suberic acid, azelaic acid, sebacic acid, phthalic acid, isophthalic acid, maleic acid and anhydrides of these acids), polylactones from lactones such as caprolactone reacted with a diol, polyethers such as polypropylene glycols, and hydroxyl terminated polyacrylics prepared by addition polymerization of acrylic esters such as the aforementioned alkyl acrylate or methacrylates with ethylenically unsaturated monomers containing functional groups such as carboxyl, hydroxyl, cyano groups and/or glycidyl groups.

Diisocyanates that can be used are as follows: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cycopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'diisocyanatodiphenyl ether, tetramethyl xylene diisocyanate and the like.

Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like.

Suitable tertiary amines which are used to neutralize the acid and form an anionic group for water dispersibility are trimethylamine, triethylamine, dimethylaniline, diethylaniline, triphenylamine and the like.

Diamines suitable for chain extension of the polyurethane include ethylenediamine, diaminopropane, hexamethylene diamine, hydrazine, amnioethylethanolamine and the like.

Solvents which may be employed to aid in formation of the prepolymer and to lower its viscosity and enhance water dispersibility include methylethylketone, toluene, tetrahydofuran, acetone, dimethylformamide, N-methylpyrrolidone, and the like. Water-miscible solvents like N-5 methylpyrrolidone are much preferred.

Various stiff fillers that have a modulus greater than 10 GPa may be used in the scratch resistant layer of the present invention, and a host of representative stiff fillers have been disclosed in U.S. Ser. No. 09/089,794. It is preferred that the stiff filler has a refractive index less than or equal to 2.1, and most preferably less than or equal to 1.6. For thick scratch resistant coatings, i.e., for dried layer thicknesses between 0.6 and 10 $\mu$m containing 30 to 60 volume % stiff filler it is important to limit the refractive index of the filler in order to provide good transparency of the layer. The filler also has a particle size less than or equal to 500 nm, and preferably, less than 100 nm. For the purpose of the present invention, colloidal silica is the most preferred filler material.

In U.S. Ser. No. 09/089,794, it has been demonstrated that at filler concentrations less than 30 volume % there is little improvement in the scratch resistance of the layer while for filler concentrations greater than 60 volume % the layer becomes too brittle and the coating may exhibit cracking due to drying induced stresses.

The electrically conducting polymer can be chosen from any or a combination of electrically-conducting polymers, specifically electronically conducting polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408), substituted or unsubstituted aniline-containing polymers (as mentioned in U.S. Pat. Nos. 5,716,550 and 5,093,439) and polyisothianapthene. The electrically conducting polymer may be soluble or dispersible in organic solvents or water or mixtures thereof. For environmental reasons, aqueous systems are preferred. Polyanions used in these electrically conducting polymers are the anions of polymeric carboxylic acids such as polyacrylic acids, polymethacrylic acids or polymaleic acids and polymeric sulfonic acids such as polystyrenesulfonic acids and polyvinylsulfonic acids, the polymeric sulfonic acids being those preferred for this invention. These polycarboxylic and polysulfonic acids may also be copolymers of vinylcarboxylic and vinylsulfonic acids with other polymerizable monomers such as the esters of acrylic acid and styrene. The molecular weight of the polyacids providing the polyanions preferably is 1,000 to 2,000,000, particularly preferably 2,000 to 500,000. The polyacids or their alkali salts are commonly available, e.g., polystyrenesulfonic acids and polyacrylic acids, or they may be produced based on known methods. Instead of the free acids required for the formation of the electrically conducting polymers and polyanions, mixtures of alkali salts of polyacids and appropriate amounts of monoacids may also be used. Preferred electrically conducting polymers include polypyrrole/poly (styrene sulfonic acid), 3,4-dialkoxy substituted polypyrrole styrene sulfonate, and 3,4-dialkoxy substituted polythiophene styrene sulfonate.

The weight % of the electrically conducting polymer in the dried layer is between 1% and 10%, preferably between 2.5% and 5%. Such a layer provides an electrical resistivity of less than 12 log Ω/□ in an ambient of 50%–5% relative humidity, and preferably less than 11 log Ω/□. Additionally, such an antistatic layer provides electrical resistivity values of less than 12 log Ω/□, preferably less than 11 log Ω/□, after undergoing typical color photographic film processing.

The overall dry thickness of the layer of the present invention is between 0.6 to 10 microns for optimum scratch resistance and antistatic properties.

Layers containing hard fillers for use in imaging elements have been described in the prior art. For example in U.S. Pat. No. 5,204,233, a silica-containing gelatin layer is described which reportedly has reduced sticking propensity. However, since gelatin does not have an elongation to break greater than 50%, the addition of hard fillers such as silica actually embrittles the layer. Backing layers comprising cellulose esters, styrene, or acrylate polymers and colloidal silica or alumina fillers are described in U.S. Pat. Nos. 4,363,871, 4,4427,764, 4,582,784, 4,914,018, 5,019,491, 5,108,885, 5,135,846, 5,250,409, and European Patent Appl. EP 296656, for example. However, these prior art references describe coating compositions comprising polymers with low elongation to break values and/or low modulus values and so they do not obtain the significant improvements in scratch resistance obtained in the present invention. In addition, these aforementioned prior art references do not teach or suggest that the polymers used in these coatings must have specific elongation to break and modulus values in order to optimize the physical properties of the dried layer.

Antistatic layers containing hard, electrically-conductive fillers such as doped-metal oxides, metal antimonates, etc. have been described in, for example, U.S. Pat. Nos. 4,275,103, 4,394,441, 4,416,963, 4,418,141, 4,431,764, 4,495,276, 4,571,361, 4,999,276, 5,122,445, 5,368,995, 5,457,013, 5,340,676, and in commonly assigned copending U.S. Ser. No. 08/847,634. In these antistatic layer compositions, the binder for the conductive filler is typically not critical and various polymers including gelatin, latex polymers prepared from ethylenically unsaturated monomers, and others are described as being useful in the layer. These references do not teach the use of a polymer binder in which the elongation to break and modulus are critical to the performance of the layer. In addition, since these fillers typically have a high refractive index, it is usually desirable to apply these layers as thin as possible to provide good transparency. Moreover, the high volume concentration required for these metal-containing conductive particles for effective antistatic characteristics is likely to make the layers extremely brittle when gelatin and other binders described in the prior art are used as the binder in thick coatings.

In addition to the ductile polymer having a modulus greater than 100 MPa and an elongation to break greater than 50% , the stiff filler having a modulus greater than 10 GPa and the electrically conducting polymer, the scratch resistant layers in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents react with the functional groups present on the ductile polymer.

Other additional compounds that can be employed in the scratch resistant layer compositions of the invention include surfactants, coating aids, coalescing aids, lubricants, dyes, biocides, UV and thermal stabilizers, and matte particles. Matte particles are well known in the art and have been described in Research Disclosure No. 308, published December 1989, pages 1008 to 1009. When polymer matte particles are employed, the polymer may contain reactive functional groups capable of forming covalent bonds with the ductile polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

Lubricants useful in the coating composition of the present invention include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly(trifluorochloroethylene), poly(vinylidene fluoride, poly(trifluorochloroethylene-co-vinyl chloride), poly(meth)acrylates or poly(meth) acrylamides containing perfluoroalkyl side groups, and the like. Lubricants useful in the present invention are described in further detail in Research Disclosure No.308119, published December 1989, page 1006.

As part of the present invention it is also contemplated to overcoat the scratch resistant layer with a thin lubricant layer. An example of a particularly useful lubricant layer for the purpose of the invention is a layer of carnauba wax.

The coating compositions of the invention can be applied by any of a number of well-know techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in Research Disclosure No. 308119, Published December 1989, pages 1007 to 1008.

SAMPLE PREPARATION

For the following examples and comparative samples, coatings were made from aqueous mixtures onto a polyester film support that had been previously coated with a vinylidene chloride-containing subbing layer method. The coatings were applied by hopper-coating at a dry coverage of 1 g/m$^2$. The coating compositions included the ductile polymer Witcobond 232 (an aliphatic polyurethane latex, supplied by Witco Corporation) and the stiff filler Ludox AM (alumina-stabilized silica, supplied by DuPont), and an electrically conducting polymer Baytron P (a 3,4-dialkoxy substituted polythiophene styrene sulfonate, supplied by Bayer Corporation). Also included in the coating composition were small amounts of a surfactant Pluronic F88 (supplied by BASF Corporation), triethylamine for pH adjustment, and an aziridine crosslinking agent Neocryl CX-100, supplied by Zeneca Corporation, (at a level of 5% dry weight of the polyurethane).

TEST METHOD

For resistivity tests, samples were preconditioned at 50% RH 72° F. for at least 24 hours prior to testing. Surface electrical resistivity (SER) was measured with a Kiethley Model 616 digital electrometer using a two point DC probe by a method similar to that described in U.S. Pat. No. 2,801,191. The SER values were measured before and after C-41 processing, a typical color photographic processing.

To assess scratch/abrasion resistance, Taber abrasion tests were performed in accordance with the procedures set forth in ASTM D1044.

EXAMPLES & COMPARATIVE SAMPLES

Detailed description of the various samples and the corresponding test data are tabulated below in Table. 1. Samples 1–4 were coated with varying ratios of Witcobond 232 (the ductile polymer), Ludox AM (the stiff filler) and Baytron P (the electrically conducting polymer) as per the present invention. The dry volume ratio of the ductile polymer to stiff filler for all these 4 samples were kept between 70:30 and 40:60. As shown in Table 1, all these samples had excellent SER values (<9.5 log Ω/), both before and after C-41 processing, indicating that these samples could provide excellent "process surviving" antistatic characteristics.

Samples A and B were coated in accordance with U.S. Ser. No. 09/089,794, comprising Witcobond 232 (the ductile polymer) and Ludox AM (the stiff filler) but no electrically conducting polymer, whereby the ductile polymer to stiff filler dry volume ratio was maintained between 70:30 and 40:60. Although scratch resistant (as per the disclosure of U.S. Ser. No. 09/089,794), neither of these samples provided sufficient electrical conductivity to be effective as antistatic layers.

The Δhaze values for samples 1 and 2 from Taber abrasion tests were found to be very close to that of sample A (within ±1.5), prepared in accordance with U.S. Ser. No. 09/089,794. This indicates that the scratch/abrasion resistance of the layers of the present invention is equivalent to that of U.S. Ser. No. 09/089,794; however, as clearly demonstrated earlier, the present invention provides far superior antistatic characteristics in comparison to U.S. Ser. No. 09/089,794.

Samples C and D were coated, comprising Witcobond 232 (the ductile polymer) and Baytron P (the electrically conducting polymer) but no stiff fillers. Although both of these samples provided excellent electrical conductivity before and after C-41 processing, the Δhaze values for samples C and D from Taber abrasion tests were found to be much higher than that of sample A, prepared in accordance with U.S. Ser. No. 09/089,794, indicating the inferiority of samples C and D in terms of scratch/abrasion resistance.

Samples E and F were coated with the dry wt % of Baytron P (the electrically conducting polymer) in the layer at 1% and 10%, respectively. In both samples ductile polymer to stiff filler dry volume ratio was maintained between 70:30 and 40:60. Sample E provided insufficient conductivity and sample F was unacceptably hazy, showing that the dry wt % of the electrically conducting polymer needs to be between 1% and 10%, as specified by the present invention.

The above examples and comparative samples demonstrate that the appropriate combination of a ductile polymer, a stiff filler and an electrically conducting polymer is needed in the layer of the present invention in order to achieve optimum scratch resistance and antistatic characteristics for application in imaging elements.

TABLE 1

| Sample | electr. cond. Polymer Baytron P dry wt. % | ductile polymer Witco 232 dry wt. % | Filler Ludox AM dry wt. % | dry volume ratio of ductile polymer to stiff filler | coverage g/m$^2$ | SER before C-41 process log Ω/ | SER after C-41 process log Ω/ | Tabor % Δ haze |
|---|---|---|---|---|---|---|---|---|
| Example 1 | 2.5 | 48.75 | 48.75 | 68:32 | 1.0 | 9.5 | 9.4 | 5.4 |
| Example 2 | 5 | 47.5 | 47.5 | 68:32 | 1.0 | 8.6 | 8.9 | 3.5 |
| Example 3 | 2.5 | 33.15 | 64.35 | 52:48 | 1.0 | 8.6 | 8.1 | |
| Example 4 | 5 | 32.3 | 62.7 | 52:48 | 1.0 | 8.4 | 8.9 | |

TABLE 1-continued

| Sample | electr. cond. Polymer Baytron P dry wt. % | ductile polymer Witco 232 dry wt. % | Filler Ludox AM dry wt. % | dry volume ratio of ductile polymer to stiff filler | coverage g/m$^2$ | SER before C-41 process log Ω/ | SER after C-41 process log Ω/ | Tabor % Δ haze |
|---|---|---|---|---|---|---|---|---|
| Comparative A | 0 | 50 | 50 | 68:32 | 1.0 | >13 | >13 | 4.9 |
| Comparative B | 0 | 34 | 66 | 52:48 | 1.0 | >13 | >13 | |
| Comparative C | 2.5 | 97.5 | 0 | 100:0 | 1.0 | 9.6 | 9.6 | 12.3 |
| Comparative D | 5 | 95 | 0 | 100:0 | 1.0 | 9.7 | 9.2 | 12.4 |
| Comparative E | 1 | 49.5 | 49.5 | 68:32 | 1.0 | >13 | | |
| Comparative F (very hazy) | 10 | 30 | 60 | 51:49 | 1.0 | 7.7 | | |

The invention has been described in detail with particular reference to certain preferred embodiments thereof, but it will be understood that variations and modifications can be effected within the spirit and scope of the invention.

What is claimed is:

1. An imaging element comprising:

a support;

an image-forming layer superposed on the support; and an outermost scratch resistant antistatic layer superposed on the support having a thickness between 0.6 and 10 microns, the scratch resistant layer comprising a polymer having a modulus greater than 100 MPa measured at 20° C. and a tensile elongation to break greater than 50%, a filler particle having a modulus greater than 10 GPa, and an electrically conducting polymer comprising 3,4-dialkoxy substituted polythiophene styrene sulfonate; wherein the volume ratio of the polymer to the filler particle is between 70:30 and 40:60 and the electrically conducting polymer is present at a weight concentration based on a total dried weight of the scratch resistant layer of between 1 and 10 weight percent.

2. The imaging element of claim 1 wherein the filler particle having a modulus greater than 10 GPa comprises a refractive index less than or equal to 2.1.

3. The imaging element of claim 1 wherein the filler particle having a modulus greater than 10 GPa comprises a particle size less than or equal to 500 nm.

4. The imaging element of claim 1 wherein outermost scratch resistant antistatic layer further comprises crosslinking agents, surfactants, coating aids, coalescing aids, lubricants, dyes, biocides, UV stabilizers, thermal stabilizers or matte particles.

5. The imaging element of claim 1 wherein the filler particle comprises colloidal silica.

6. The imaging element of claim 1 wherein the electrically conducting polymer further comprises substituted pyrrole-containing polymers, unsubstituted pyrrole-containing polymers, substituted aniline-containing polymers, unsubstituted aniline-containing polymers or polyisothianapthene.

7. The imaging element of claim 1 wherein the polymer having a modulus greater than 100 MPa measured at 20° C. and a tensile elongation to break greater than 50% comprises polycarbonate, polyurethanes or polyolefins.

8. The imaging element of claim 1 wherein the filler particle having a modulus greater than 10 GPa comprises colloidal silica, colloidal tin oxide, colloidal titanium dioxide, mica, clays, doped-metal oxides, metal oxides containing oxygen deficiencies, metal antimonates, conductive nitrides, carbides, or borides.

9. The imaging element of claim 1 wherein the electrically conducting polymer is present at a weight concentration based on a total dried weight of the scratch resistant layer of between 2.5 and 5 weight percent.

10. The imaging element of claim 1 wherein the support is selected from a polymeric film, paper, or glass.

11. The imaging element of claim 1 wherein the imaging element has SER values ≦9.5 log Ω/.

12. The imaging element of claim 1 wherein the filler particle is amorphous silica.

* * * * *